United States Patent [19]

Bienaime

[11] Patent Number: 4,936,455

[45] Date of Patent: Jun. 26, 1990

[54] MULTIPACK FOR CONTAINERS

[75] Inventor: Patrick Bienaime, Troissereux, France

[73] Assignee: Unilever Patent Holdings B.V., Rotterdam, Netherlands

[21] Appl. No.: 383,409

[22] Filed: Jul. 24, 1989

[30] Foreign Application Priority Data

Jul. 25, 1988 [FR] France ..... 88 10002

[51] Int. Cl.[5] ..... B65D 65/06; B65D 85/62

[52] U.S. Cl. ..... 206/427; 206/151; 229/89

[58] Field of Search ..... 206/150, 151, 158, 145, 206/147, 162, 193, 194, 197, 199, 427; 229/89, 178, 180

[56] References Cited

U.S. PATENT DOCUMENTS

| | | | |
|---|---|---|---|
| 3,425,543 | 2/1969 | Harvey | 229/178 |
| 3,923,155 | 12/1975 | Tanzer | 206/427 |
| 4,180,200 | 12/1979 | Wilkinson, Sr. | 229/178 |
| 4,273,273 | 6/1981 | Zenri | 206/145 |
| 4,378,879 | 4/1983 | Killy | 206/199 |
| 4,465,180 | 8/1984 | Klygis | 206/151 |
| 4,597,523 | 7/1986 | Schuster | 206/427 |
| 4,621,734 | 11/1986 | Heijnen et al. | 206/158 |

FOREIGN PATENT DOCUMENTS

| | | | |
|---|---|---|---|
| 3627564 | 8/1986 | Fed. Rep. of Germany | 206/145 |

*Primary Examiner*—Paul T. Sewell
*Assistant Examiner*—Jacob K. Ackun, Jr.
*Attorney, Agent, or Firm*—Cushman, Darby & Cushman

[57] ABSTRACT

A central panel (1) includes openings (01–04) and two first side panels (2,3) that are located opposite each other, each side panel being connected to the central panel along a folding line (15) and consisting of a middle section and two end sections (2', 2", 3', 3") located opposite each other, each of which is provided with a projecting tab (17) on one edge opposite the folding line; two second side panels that are located opposite each other and each consist of a first section connected to said first section by a second folding line (22) that is essentially parallel to the first one, at least one cut (21) being provided in the area of the second folding line of each second side panel; said tabs and said cuts are positioned in such a way that the blank is folded into an inverted tray shape when said tabs are moved towards said cuts and is held in this shape by folding said second sections against said first sections to lock said tabs and thus to secure said end sections in place.

9 Claims, 5 Drawing Sheets

MULTIPACK FOR CONTAINERS

SUMMARY OF THE INVENTION

The present invention relates in general to a multipack for containers with necks such as bottles etc. and relates in particular to a blank designed to form a multipack for these articles and to a process for erecting the multpack.

Multipack' here means a structure in the shape of an inverted shell or tray, provided with side panels surrounding the group of containers for at least part of their height and a top panel with openings to accommodate the necks of the containers.

Multipacks produced from a board or plastic blank, erected by appropriate folding and held in this shape e.g. by gluing have already been disclosed in the prior art.

The aim of the present invention is to create a multipack without gluing, by carefully designed locking of different sections of the blank.

Another aim of the invention is to propose improved ways to ensure mutual securing of the multipack and the containers, so that the stability of the multipack is increased.

The present invention therefore relates first of all to a blank for multipacking a number of containers such as bottles, with the following features:

- a central panel that defines openings for the necks of the containers to at least some extent;
- two first side panels that are located opposite each other, each side panel being connected to the central panel along a folding line and consisting of a middle section and two end sections located opposite each other, each of which is provided with a projecting tab on one edge opposite the folding line;
- two second side panels that are located opposite each other and each consist of a first section connected to the central panel along a first folding line and a second section connected to said first section by a second folding line that ist essentially parallel to the first one, at least one cut being provided in the area of the second folding line of each second side panel;
- said tabs and said folding lines are positioned in such a way that the blank is folded into an inverted tray shape when said tabs are moved towards said cuts and is held in this shape by folding said second sections against said first sections to lock said tabs and thus to secure said end sections in place.

The blank produced in accordance with the present invention preferably has the following characteristics:

- said second folding lines are interrupted in the area of said cuts which project into said second sections,
- the openings for the necks of the containers are each surrounded by a series of locking tabs that engage the containers flexibly below projecting sections of said necks,
- each of said second sections has on its outer edge at least one tab which completes said locking tabs around said openings when said section is folded into place,
- said end sections of the first side panels consist of extensions to said sections that curve inwards,

- said end sections have inner extensions provided with tabs which are located underneath certain of said locking tabs when said blank is erected,
- the blank is designed for two rows of containers with necks,
- said end sections are separated from said middle sections by folding lines,
- each of said second sections is extended laterally by two wings separated from said sections by folding lines which are located essentially on top of said folding lines of said end sections when the blank has been erected, while said wings overlap parts of said middle sections and each of said wings has on an edge adjacent to the outer edge of the corresponding second section at least one tab which is located underneath at least one corresponding locking tab when the blank has been erected,
- each of said first side panels has on its outside an extension section separated from its middle section by two folding lines which define between them a generally elliptical holding section,
- each of the extension sections is provided on its outer edge with at least two tabs which complete the locking tabs of at least two different openings for the necks of containers when the blank is erected, in the course of which said extension sections are folded against said middle sections.

The invention also relates to a process for multipacking a number of containers with necks with the help of a blank as defined above, consisting of the following stages:

- placing the tabs of the end sections on the cuts of the second side panels by bending said first and second side panels to give the blank the shape of an inverted tray,
- folding the second sections inwards against the first sections to secure said tabs and said end sections and thus to maintain the shape of the multipack and
- inserting said containers, which have projecting sections round their necks in the openings for the necks, with the result that said second sections are secured in their folded positions.

Other aspects, aims and advantages of the present invention will become more apparent on reading the following detailed description of a preferred embodiment of the same, which is given by way of example and refers to the appended drawings of the same:

DETAILED DESCRIPTION OF THE INVENTION

Figure 1:
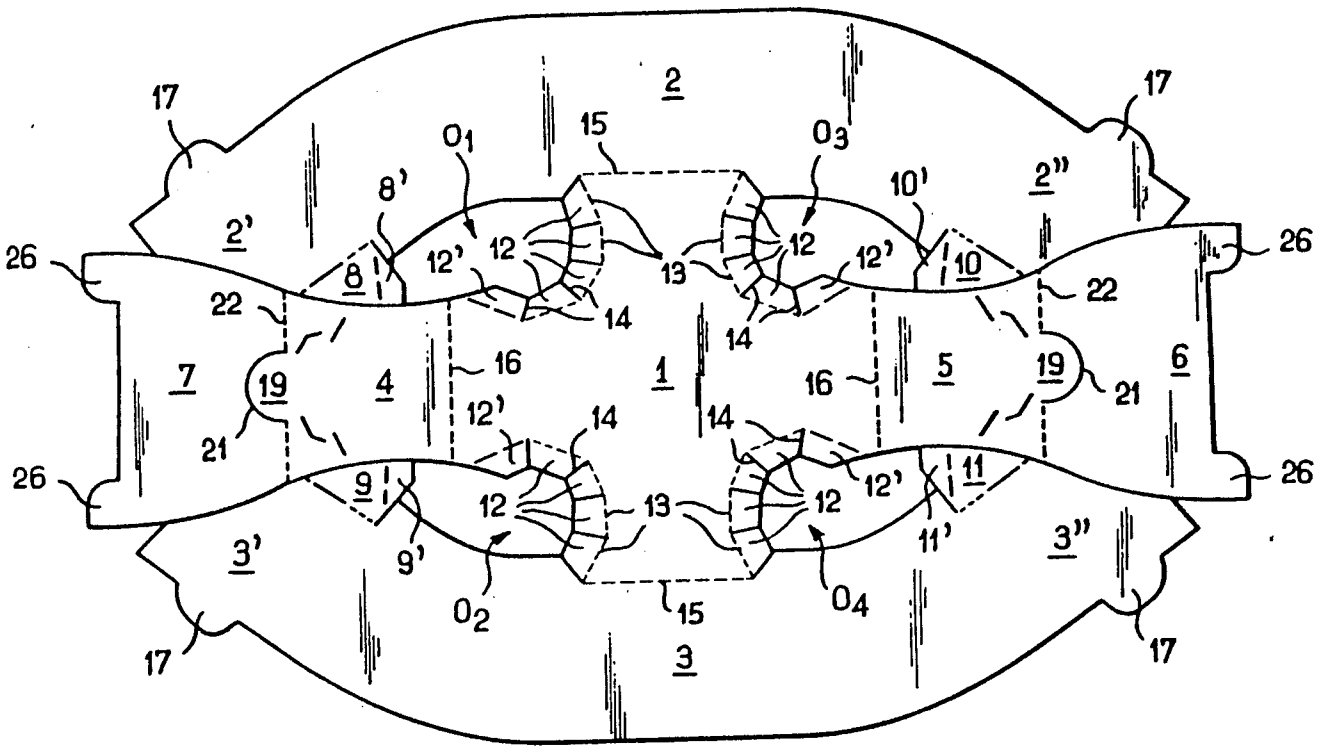
FIG. 1 shows a blank for a multipack according to a first main embodiment of the present invention.

FIGS. 1, 3, 4 and 5 show flat blanks designed according to the invention. In these figures the uninterrupted lines indicate cuts, while the dotted lines indicate folding lines, produced for example in the form of perforations at intervals along the sheet and/or continuous creases through only part of its thickness.

The designs of the blanks illustrated in detail in the drawings are to be considered included in the present description.

With reference first of all to FIG. 1, a blank for a multipack consists of a central panel 1 intended to form an essentially horizontal top panel of a multipack after erection and positioning on a number of bottles —in this case four —with insertion of the necks of the latter as will be seen in detail later on the panel 1 to some extent defines four essentially circular openings $0_1$ to $0_4$ in the area of its four corners as illustrated.

The top of the multipack which is provided to enclose the bottles after the former has been erected and put in place, is defined by four side panels of the blank numbered 2, 3, 4, 5 connected to the central panel 1 by four folding lines 15, 15 and 16, 16 respectively, these folding lines basically defining a rectangle. The side panels 2, 3, located opposite each other and corresponding to the long sides of the rectangle, each have a middle section and two end sections, 2', 2" and 3', 3" respectively, which extend the middle section beyond the ends of the folding line 15 and curve inwards as illustrated.

Each of the four end sections is provided on its outer edge (opposite the folding line 15) adjacent to the end edge a projecting locking tab 17 for purposes that will be explained later on.

The end sections 2', 3', 2", 3" are also provided on the opposite side to said tabs 17 with inner extensions 8, 9, 10, 11 respectively, each of which has a flap 8', 9', 10', 11' hinged to said extension along a folding line.

The shape and orientation of these flaps as illustrated have a purpose that will be explained below.

The two other side panels of the blank, corresponding to the short sides of the rectangle outlining the central panel 1, have a first section 4 and 5 respectively which has appreciably the same width as the folding lines 16, 16 respectively, being limited by two concave opposite edges. The sections 4 and 5 are extended on the opposite side to the central panel 1 by two second sections or final sections 6, 7 along folding lines 22.

Said final sections widen towards the outside as illustrated and are provided at the ends of their respective outer edges with two projecting tabs 26, for purposes that will be explained further on.

A semi-circular cut 21 that points outwards and defines a correspondingly shaped tab 19 that appears out of the fold as we will see later on, is provided in the middle of each of the two above-mentioned folding lines 22.

The openings 01–04 for bottle necks have a diameter which is smaller than that of the bottle necks and are defined by a series of generally trapezoidal tabs 12, that are separated from each other by cuts 14 and are hinged along folding lines 13.

The blank is erected in the following way.

Figure 2:
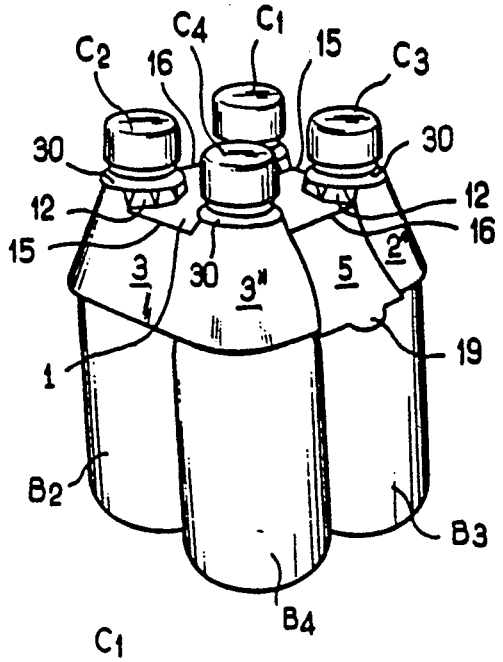
FIG. 2 shows a group of four bottles multipacked with the help of the blank illustrated in FIG. 1, following its erection.

The end sections 2', 3' of the panels 2,3 are first of all moved towards each other beneath section 4 in such a way that their respective tabs 17 are essentially located above each other. This operation is accompanied by a bending of the side panels in the area of their curved sections, so that the blank starts to take on its final, inverted-tray shape, as can be seen in FIG. 2.

To lock the blank in this position, the final section 7 of the side panel of the blank considered here is folded inwards through about 180° along the folding line 22 against the back of the adjacent section 4, in such a way that the tabs 17 are secured between the two sections of the folding line 22 folded through 180° and the end sections 2', 3' are at the same time sandwiched between the sections 4 and 7.

The same operations are carried out simultaneously or subsequently at the other end of the blank, the tabs 17 and 19 being engaged in the same way and the end sections 2", 3" of the panels 2, 3 of the blank being secured between the sections 5, 6 with said tabs 17 being locked.

In this way, a multipack with the shape of an inverted tray with a generally square outline is obtained. It is important to note here that in this position the flaps 8' to 11' provided on the inner extensions 8 to 11 of the side panels 2 and 3 are located underneath the tabs 12' that are around the four openings for bottle tops.

The tabs 26 provided on the ends of the folded sections 6 and 7 are in addition now located beside said tabs 12', essentially in extension of the folding lines 16, for purposes that are explained below.

The present multipack for containers is suitable for being used for example with bottles whose necks or caps or other closures have a flange or some form of projection.

In the present case, the bottles Bl–B4 illustrated in FIG. 2 have a projection numbered 30 just below their respective caps C1 to C4.

When the various tabs 12, 12', 8' to 11' and 26 are properly positioned in the area of the central panel 1 of the multipack, the bottles are inserted one after another or simultaneously from below the multipack. When the caps and projections pass through, they flexibly bend the various tabs which, after they have been cleared by said projections, engage the bottles flexibly below said projections, thus securing the bottles firmly in the multipack.

The group of four bottles can thus be taken hold of easily by one or more edges of the multipack.

To make sure that the bottles are secured satisfactorily in the multipack, it is particularly advantageous if the distance between the lower edge of the projection and the area where the neck widens, where the bottle rests against the lower surface of the central panel 1 of the multipack, is only slightly greater than the height of the various tabs when they are in their locking position against the neck of the bottle below the projection.

It can be pointed out here that this particular way of mutually securing the bottles and the multipack makes is possible to secure firmly the sections whose role is to keep the multipack in its final shape. In particular, the tabs 26 applied against the necks of the bottles help to keep the sections 6 and 7 in place behind the sections 4 and 5, while the tabs 8' to 11', which are secured between the tabs 12' and the necks, effectively strengthen the positioning of the side panels 2, 3 in their curved areas.

The multipack thus remains sturdy, rigid and stable even if it is handled roughly.

Figure 3:
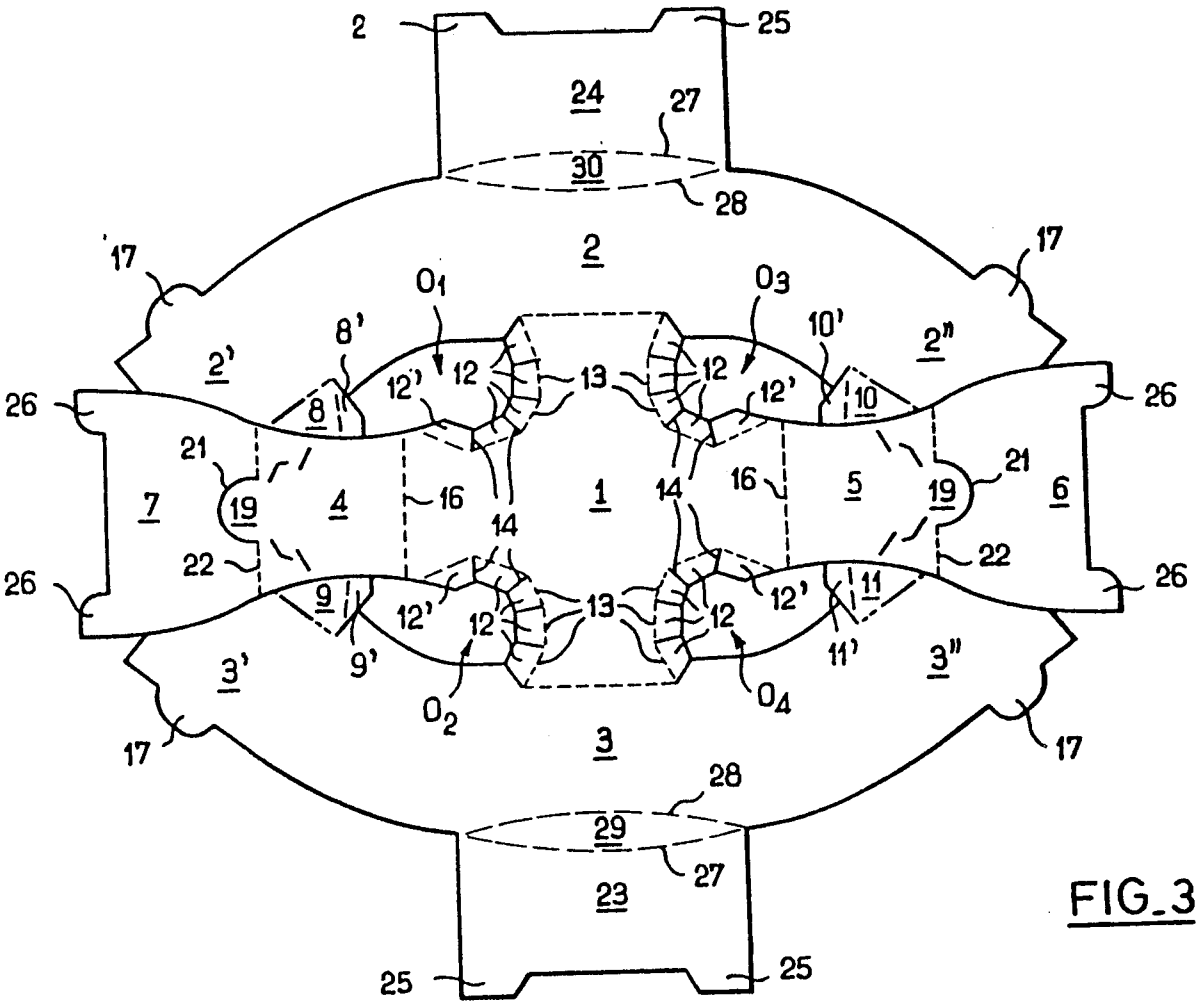
FIG. 3 shows an alternative design for the blank shown in FIG. 1.

FIG. 3 shows a different design for the embodiment shown in FIG. 1. In this figure the elements or sections that are identical or similar to those shown in FIG. 1 have been given the same reference numbers.

In this alternative, the side panels 2, 3 of the blank are extended on the outside by two sections 23 and 24 respectively, that are intended to be folded inwards against the middle sections of said panels 2, 3 when the multipack is erected.

As can be seen, each section 23, 24 is connected to its respective panel 2, 3 by a pair of adjacent folding lines 27, 28 that define an intermediate section 29 and 30 respectively that has an elliptical shape.

In addition, projecting tabs 25, that are similar in shape and function to the tabs 26 of the sections 6,7, are provided at the ends of the outside edge of each of the sections 23, 24.

In the course of erection of the multipack, when the sections 23, 24 are folded against the sections 2, 3, the shape and the position of the folding lines 27 and 28 are such that the sections 29 and 30 are positioned essentially transversely to the neighbouring sections and thus represent reinforced sections for taking hold of the group of bottles by their multipack in the area of the edges concerned here. In addition, since the tabs 25 rest closely against the bottles when the latter are inserted, they help to make sure that sections 23, 24 are kept in place effectively.

When the multipack containing the bottles is taken hold of by its opposite edges incorporating the sections 29, 30 there ist not therefore any risk that the blank will tear or come apart due to the application of excessive force.

Figure 4:
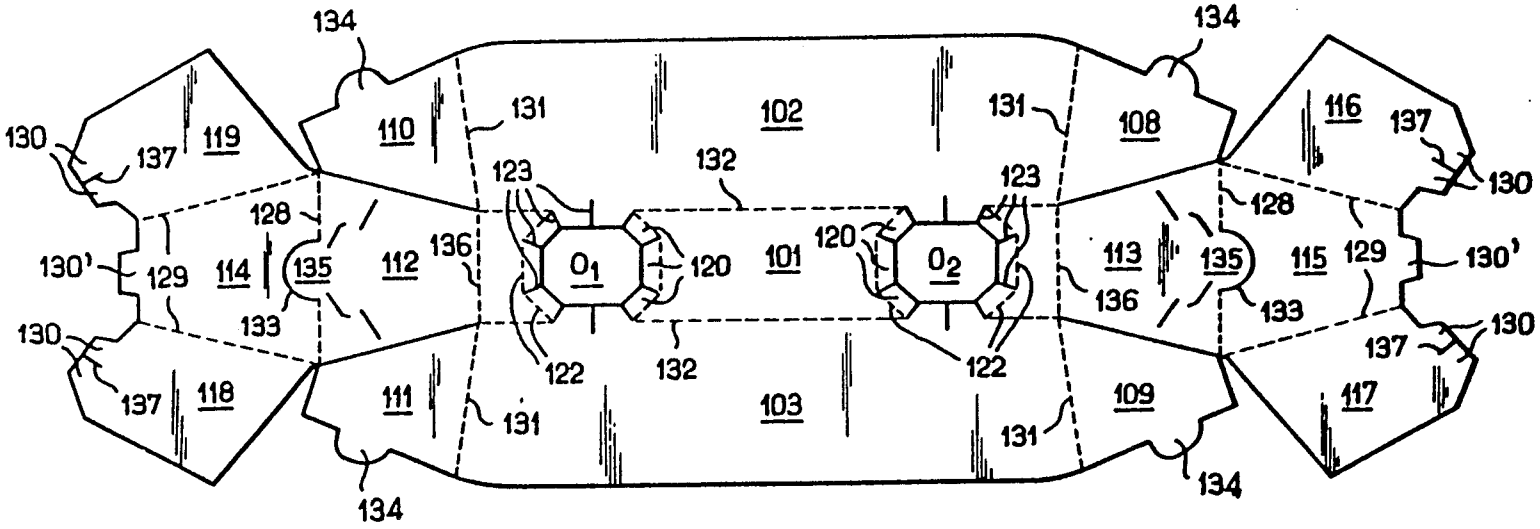
FIG. 4 shows a blank for a multipack according to a second main embodiment of the present invention.

FIG. 4 shows a blank that corresponds to a second main embodiment of the present invention.

It is intended for multipacking two bottles and for this purpose has in a central section 101 that is shaped like a lengthened rectangle two openings 01 and 02 for the necks of said bottles.

Two first side panels 102, 103 corresponding to the long sides of the rectangle have a middle section next to which are two end sections 108, 110 and 109, 111 respectively. The folding lines 132 separate the central panel 101 from the side panels 102, 103, while the folding lines 131 in the side panels 102, 103 sparate their middle sections from their end sections. Each of the four end sections 108 to 111 has on its outer edge (opposite the folding line 132) a projecting tab 134 similar to the tab 17 in FIG. 1.

Each of the two other side panels of the blank, corresponding to the short sides of the rectangle, has a first section 112, 113 respectively adjacent to the end sections and separated from the central panel 101 by a folding line 136. Each first section is extended by a trapezoidal second section 114, 115 respectively, that is essentially symmetrical to the first section along a folding line 128.

As in the case of FIG. 1, a semi-circular cut 133 that points outwards is provided in an area where the line 128 is interrupted, to define a projecting tab 135 when the blank is folded.

A projecting tab 130', which behaves similarly to the tabs 26 in FIG. 1 when the multipack is erected, is provided on the outer edge of the second sections 114, 115.

In addition, two wings 118, 119 and 116, 117 respectively, defined by folding lines 129 are provided adjacent to said second sections 114, 115.

Each of these wings has a tab 130 along its outer edge adjacent to the outer edge of the neighbouring second section, for puposes that will be explained later on.

It is also preferable if the length of the folding lines 129 is appreciably the same as the length of the folding lines 131.

Finally, the blank has a series of tabs 120 around each of the openings 01 and 02 for the necks, that are separated from each other by radial cuts 123 and are hinged along folding lines 122 as illustrated, for the purposes of locking.

The blank is erected in the following way: the end sections 110, 111 of the first side panels 102, 103 are moved towards each other to pass under section 112 with folding along the lines 131, in such a way that their respective tabs 134 are positioned above each other below tab 135. Section 114 with its two wings 118, 119 is then folded through 180° underneath the section 112 so that, as in the embodiment shown in FIG. 1, said tabs 134 are secured between the two sections of the folding line 128. At the same time, the folding lines 129 are located approximately on top of the folding lines 131 to form an elbow such that section 114, as has been indicated, is behind section 112, while the sections 118 and 119 rest against the areas of the side panels 102 and 103 located just to the right of the lines 131 on FIG. 4. At the same time, the tabs 130 und 130' are located underneath the tabs 120 which order the left-hand section of the opening 01.

Figure 6:
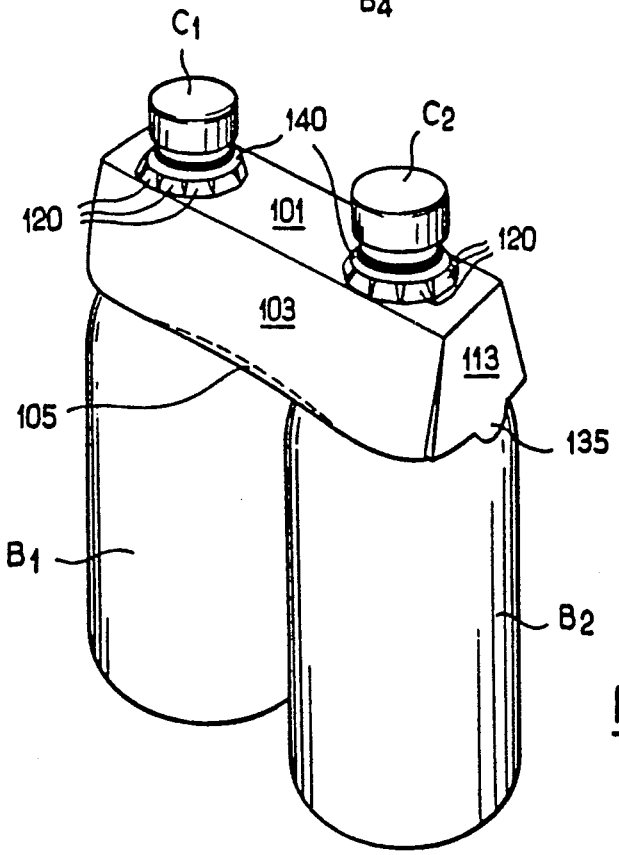
FIG. 6 shows a group of two bottles multipacked with the help of the blank shown in FIG. 5, following its erection.

The same operations are carried out simultaneously or subsequently at the opposite end of the blank, so that the latter has the general shape as a finished multipack of an inverted trough as illustrated in FIG. 6.

When the two bottles B1 and B2 provided with projections 140 are inserted in the multipack from below,- the flaps or tabs 120, 130 and 130', which surround the openings 01 and 02, are first of all pushed flexibly outwards to let the cap and the projection respectively through and then under the influence of the force of elasticity created return to engage the bottles below the projection 140, in this way securing the bottles firmly in the multipack. This operation has the additional effect of helping to keep the sections 114, 118, 119 and 115, 116, 117 of the inside of the multipack in place, i.e. the general security of the multipack is increased.

Figure 5:
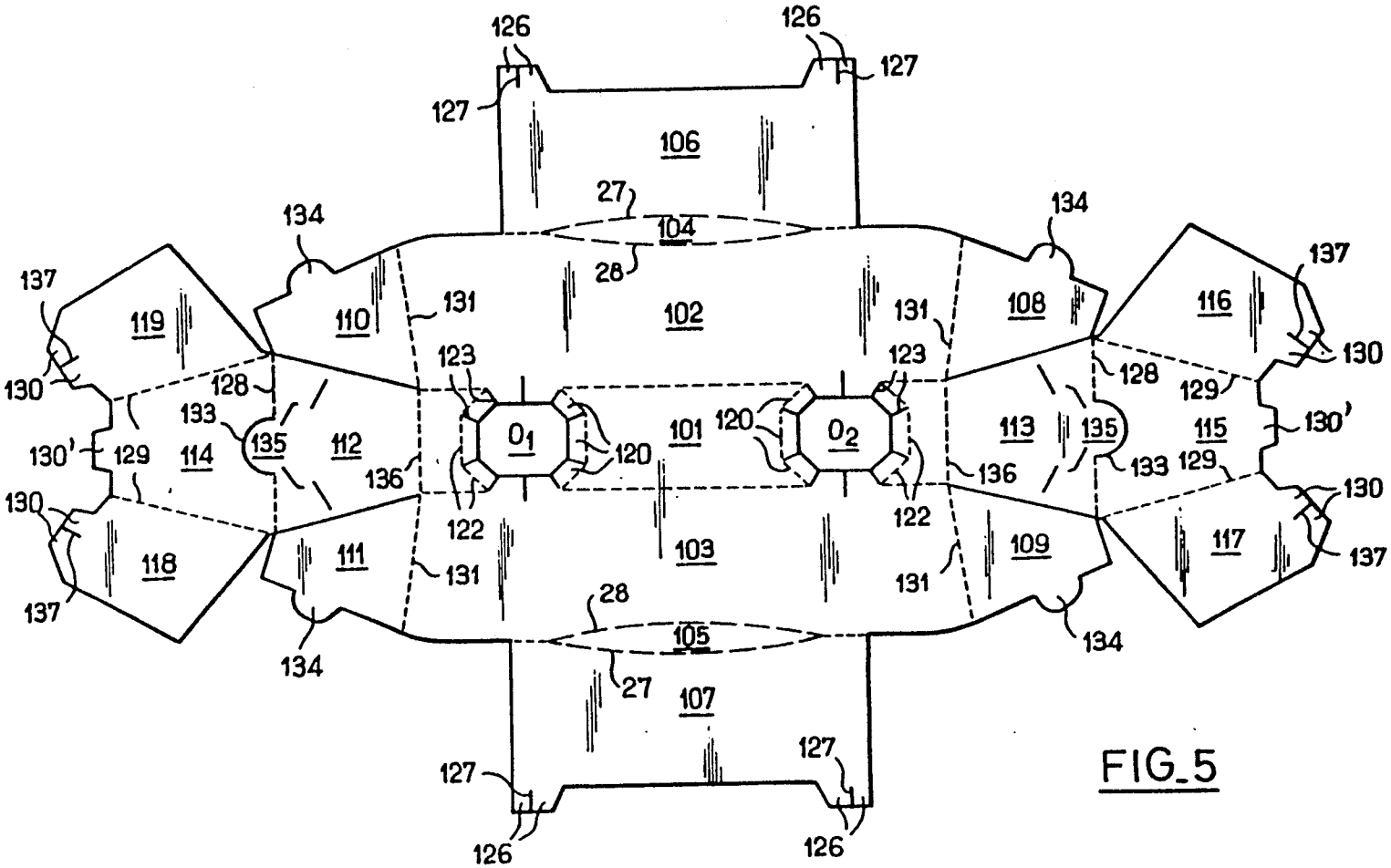
FIG. 5 shows an alternative design for the blank shown in FIG. 4.

The alternative shown in FIG. 5 differs from the main embodiment shown in FIG. 4 in that the side panels 102 and 103 are extended on the outside by sections 106 and 107, with intermediate elliptical sections 104 and 105 being provided. The sections 106, 107 have at the ends of their outer edges double tabs 126 that are separated by a transverse cut 127.

In the course of erection of the multipack, the sections 106, 107 are folded against the adjacent side panels 102, 103 to define two lateral holding sections in the area of the elliptical sections 104, 105, as is clearly shown in FIG. 6.

As in the case of FIG. 3, it is therefore possible to take hold of the multipack with the bottles without damaging said multipack, even when the total weight is relatively high.

It can be pointed out that the tabs 126 are located underneath the tabs 120 of the openings 01 and 02 opposite each other when the sections 106, 107 are folded, so that the effect of insertion of the bottles is to secure the said sections 106, 107 firmly into place.

The different blanks outlined in the course of the above description can be produced from any material that is suitable for the application in question, particularly plastic film or relatively stiff board. As has been indicated, it is important that the material has a certain inherent elasticity so that an adequate force of elastic return is applied in the area of the tabs that are intended to secure the bottle necks, so that said tabs engage the bottles firmly below the projections of said necks.

As an alternative in this connection, these tabs can engage the containers below their caps or other closures, in which case the necks can be smooth.

The expert will of course know how to adapt the blanks described here to accommodate any number of bottles, it being understood that FIGS. 1 to 3 apply preferably to the multipacking of bottles in two rows and that FIGS. 4 to 6 apply to multipacking a single row of bottles.

The invention applies incidentally to the multipacking of all containers with a neck and more generally to all objects having a similar shape.

In order to make it easier to pick up the multipack holding the bottles, particularly when the elliptical holding sections are not provided, finger holes can be provided in the top panel 1 or 101 of the multipack in a conventional way.

More tabs 17 or 134 and the corresponding cuts 21 or 133 can be provided; for example, two tabs can be provided in each of the sections 2', 3', 2'', 3'', in which case two cuts will be provided in the area of the folding lines 22.

In this connection, the semi-circular cuts 21 or 133 can be replaced by straight cuts extending the corresponding folding lines 22 or 128. In this case, when the blank is erected, it will be necessary to insert the locking tabs in the slits defined by these cuts when the sections concerned are aligned.

The blanks produced in accordance with the present invention can, finally, be erected manually or automatically.

Other alternatives or modications may of course occur to the expert and are also covered by the present invention.

I claim:

1. A blank for a multipack of a number of containers with necks, such as bottles, said blank comprising a central panel including openings for the necks of the containers;

two first side panels each connected to an opposite side of said central panel at a middle section thereof along a first fold line, each said first side panel having opposite end sections which curve toward the corresponding end portion of the other first side panel, each end section having an outer edge provided with a tab remote from said first fold line;

two second side panels joined to said central panel on opposite sides thereof along respective second fold lines which extend in a direction substantially perpendicular to said first fold lines for said first side panels, each said second side panel comprising first and second sections joined by a third fold line with said first sections being connected to said central panel along said second fold lines and said second sections being connected to said respective first sections by said third fold line extending parallel to said second fold line, a cut line extending from said third fold line between said first and second sections;

said tabs of said end sections of said first side panels being located so that when said first side panels are folded along said first fold lines toward said cut lines and said second sections are folded onto said respective first sections, said blank will assume a tray shape and said tabs and end sections of said first side panels will be locked in place by said first and second sections of said second side panels.

2. Blank according to claim 1, wherein said third fold lines (22; 128) are interrupted in the area of said cuts (21; 133) which project into said second sections (6, 7; 114, 115).

3. Blank according to one of claims 1 and 2, wherein the openings (01–04; 01–02) for the necks of the containers are each surrounded by a series of locking tabs (12, 12'; 120) that will engage the containers flexibly below projecting sections (30; 140) of said necks.

4. Blank according to claim 1, wherein each of said first side panels has on its outside an extension section (23, 24; 106, 107) separated from its middle section by two folding lines (27, 28) which define between them a generally elliptical holding section (29, 30; 104, 105).

5. Blank according to claim 4, wherein each of the extension sections is provided on its outer edge with at least two tabs (25; 126) which complete the locking tabs (12; 120) of at least two different openings for the necks of containers when the blank is erected, in the course of which said extension sections are folded against said middle sections.

6. The invention as claimed in claim 1 wherein said end sections of said first side panels each have inner edges provided with extension portions and said openings for the neck of the containers are provided with locking tabs and said extension portions are positioned to underlie at least one of said locking tabs when said blank is formed.

7. The blank as claimed in claim 3, wherein each of said second side panels has an outer edge and at least one tab for cooperating with a portion of said locking tab of said openings when said second side panels are folded into position.

8. The blank as claimed in claim 6, wherein four of said openings are provided about said central panel.

9. The blank as claimed in claim 1, wherein said second sections of said second side panels each have opposite edges and wing portions extending laterally from said edges, said wing portions having a size such that when said second sections are folded onto said first sections of said second side panels, said wing portions at least partially overlap portions of said first side panels, said wing portions each having tabs located to overlap a said locking tab of a said opening when said blank is formed.

* * * * *